United States Patent [19]

Krowech

[11] 4,421,067

[45] Dec. 20, 1983

[54] APPARATUS AND METHOD FOR SOOT CLEANING IN HIGH-PRESSURE HEAT EXCHANGERS

[75] Inventor: Robert J. Krowech, Minneapolis, Minn.

[73] Assignee: Deltak Corporation, Minneapolis, Minn.

[21] Appl. No.: 415,318

[22] Filed: Sep. 7, 1982

[51] Int. Cl.[3] ..... F22B 37/52; F28G 9/00

[52] U.S. Cl. ..... 122/390; 15/317

[58] Field of Search ..... 122/379, 390, 391, 392; 15/316, 317, 318

[56] References Cited

U.S. PATENT DOCUMENTS

| | | | |
|---|---|---|---|
| 803,562 | 11/1905 | Dean . | |
| 821,087 | 5/1906 | Charvat . | |
| 915,347 | 3/1909 | Hamann . | |
| 1,577,309 | 3/1926 | Sorensen . | |
| 1,614,502 | 1/1927 | Thomas . | |
| 1,978,555 | 10/1934 | Snow . | |
| 2,109,855 | 3/1938 | Arey et al. . | |
| 2,112,896 | 4/1938 | Husband . | |
| 2,263,595 | 11/1941 | Sinkko . | |
| 2,309,889 | 2/1943 | Eves | 15/318 |
| 2,803,842 | 8/1957 | Fuller | 15/317 X |
| 3,089,468 | 5/1963 | Clark . | |
| 3,123,132 | 3/1964 | Hedgecock . | |
| 3,541,999 | 11/1970 | Winkin et al. . | |
| 3,835,817 | 9/1974 | Tuomaala . | |
| 4,018,267 | 4/1977 | Tomasicchio . | |
| 4,093,242 | 6/1978 | Terry . | |
| 4,257,355 | 3/1981 | Cook . | |
| 4,257,359 | 3/1981 | Capobianco | 122/390 |

*Primary Examiner*—Edward G. Favors

*Attorney, Agent, or Firm*—Quarles & Brady

[57] ABSTRACT

A valve-controlled pneumatic actuator is used to actuate a movable cleaning head to remove soot, ash or other sediment from tubes, headers and other internal parts of a heat exchanger of the type used in coal gasification plants. A rotary sootblower tube is coupled to a stationary inlet tube in a chamber of the heat exchanger vessel where a hot, highly pressurized and dirty gas circulates. Both the actuator and the stationary inlet tube are fixed to the vessel so that seals for moving parts are avoided. In one embodiment, the blowing tube extends in the inlet tube to a free end, and in another embodiment the opposite end is mounted to rotate around a stub tube. The blowing medium is provided in a jet or blast through nozzles in the blowing tube to loosen soot in the internal parts of the heat exchanger. The blowing medium is also used to power the actuator. In another embodiment a rapper head is carried by an actuator shaft, and an actuator piston is moved through a rapid stroke to strike a lower header and loosen accumulated deposits with the resulting vibrations.

20 Claims, 7 Drawing Figures

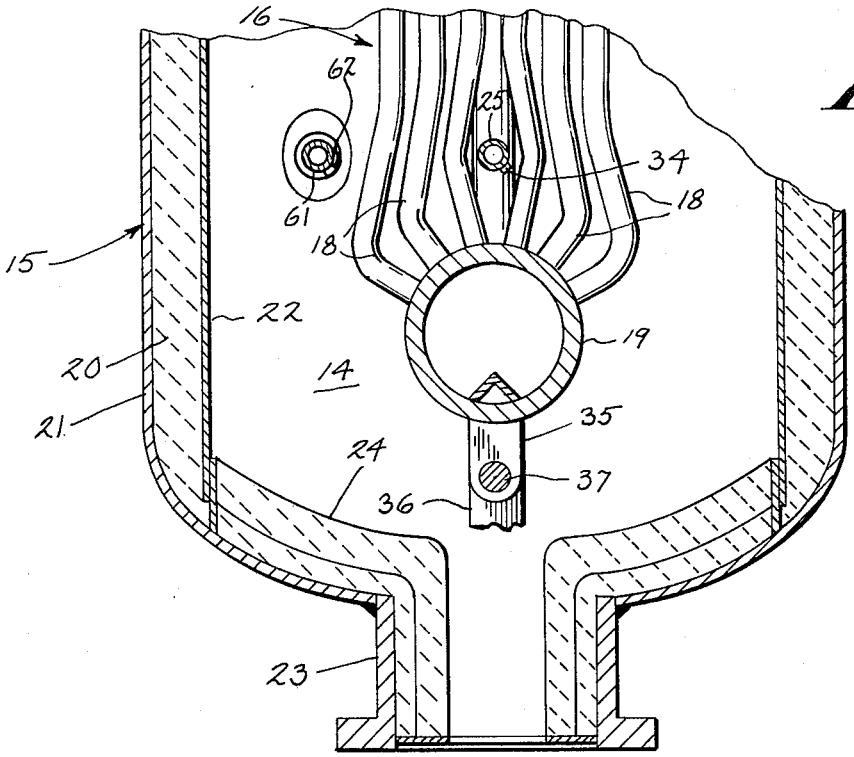
Fig. 2
Fig. 3
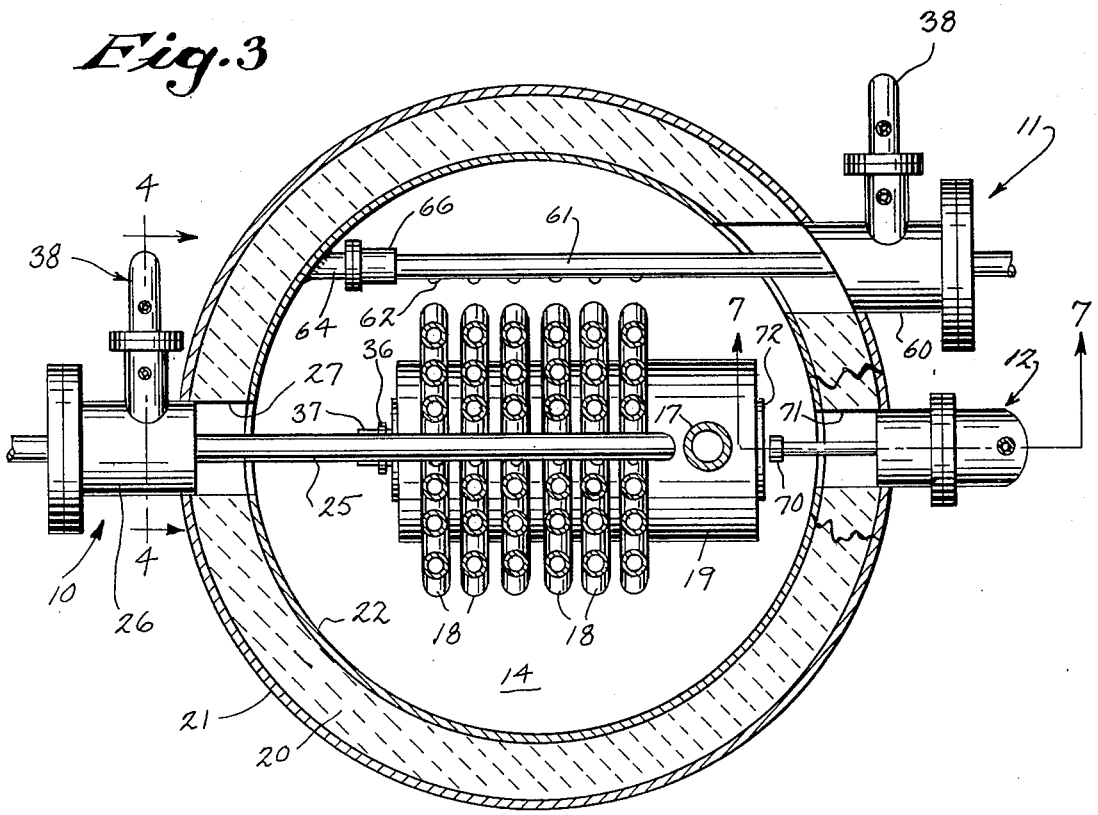

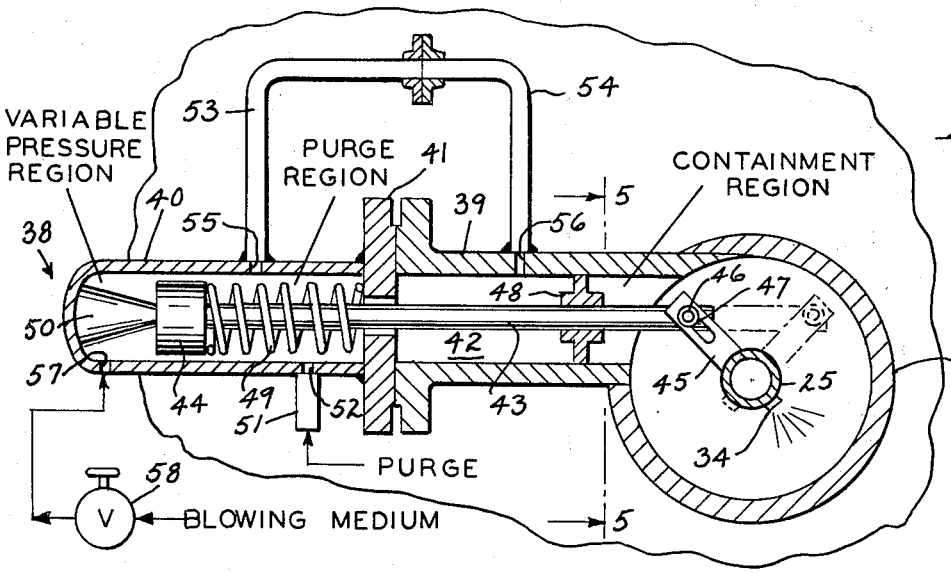
Fig. 4
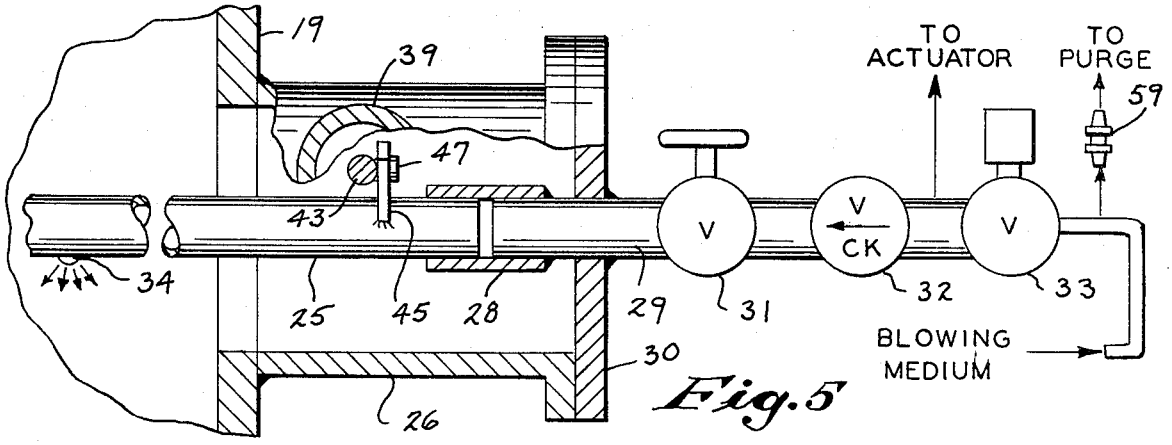
Fig. 5
Fig. 6
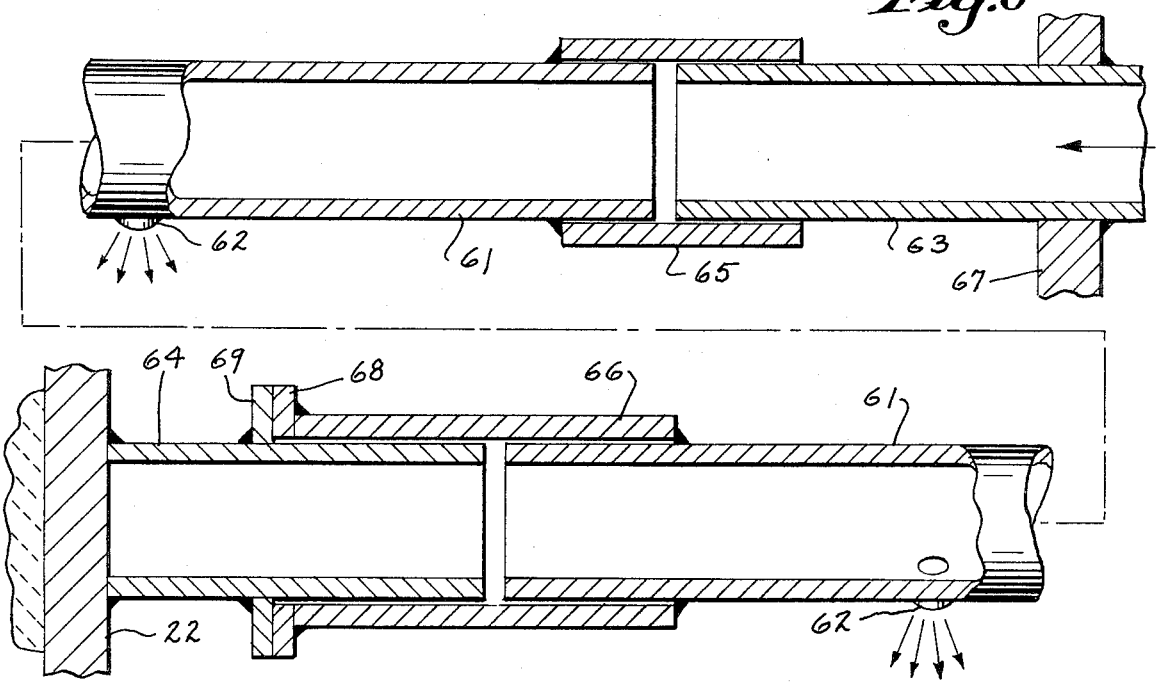

APPARATUS AND METHOD FOR SOOT CLEANING IN HIGH-PRESSURE HEAT EXCHANGERS

BACKGROUND OF THE INVENTION

1. Field of the Invention

The invention relates to devices for cleaning soot, ash and other sediment that tends to collect on heat transfer structures within heat exchangers. These cleaning devices include sootblowers in which a jet or blast of steam, air or another blowing medium is directed through a sootblower tube and out one or more nozzles onto the surfaces of the heat transfer structure to loosen and remove accumulated deposits of soot, ash and the like. These cleaning devices also include rappers in which a hammer-like head raps a header or other part of the heat transfer structure.

2. Description of the Prior Art

Prior soot cleaning devices pose a common problem, that of sealing around a movable sootblower tube or tube rapper shaft that extends through the wall of a boiler, superheater, preheater, or other heat exchanger. For example, Terry, U.S. Pat. No. 4,093,243, issued June 6, 1978, shows a rather elaborate ring-shaped seal, which is positioned around a retractable and rotatable sootblower tube as it extends through a wall box into a boiler chamber. Tuomaala, U.S. Pat. No. 3,835,817, issued, Sept. 17, 1974, shows a rotatable drive shaft for a rapper device that extends through a boiler wall, however, the problem of sealing that is presented by such a shaft is not discussed. Tomasicchio, U.S. Pat. No. 4,018,267, shows an oscillator type of soot cleaning device where a shaft from a pneumatic actuator passes through the wall of a heat exchanger and where an annular plug seal is used at the point of shaft penetration. While such seals might be acceptable for heat exchangers using clean gases at low or nearly atmospheric internal pressure, they present a problem where a heated, highly pressurized gas is present. This is the case presented by the boilers and superheaters used for heat transfer and heat recovery in coal gasification plants.

In such plants, typical mechanical seals would present three disadvantages. First, any leakage or failure would result in the escape of the heated, noxious or potentially combustible gas into the plant environment. Second, such seals would be formed at a pressure boundary between the high internal pressure of the heat exchanger and a much lower pressure outside the heat exchanger. Mechanical seals would be more likely to leak or fail under this pressure differential. And third, it would be difficult to design a simple and efficient mechanical seal for these heat exchangers that would accommodate the retraction, extension or rotation of a cleaning device through a wall of a heat exchanger vessel.

SUMMARY OF THE INVENTION

The invention resides in several devices and a method for soot cleaning in which a movable cleaning head is positioned in the heat exchange chamber and actuated through an opening in a wall of the heat exchanger vessel with a pneumatic actuator that seals the opening into the chamber. The actuator has a pressure cylinder to contain any of the pressurized gas that enters it from the vessel chamber. A blowing medium at greater pressure than the pressure of the gas in the boiler chamber is admitted into the actuator cylinder for a timed interval, to move the piston through its stroke to operate the movable cleaning head between a first position and a second position.

In a first embodiment, the cleaning device is a sootblower with an inlet tube for introducing a pressurized blowing medium into the vessel chamber. Like the actuator, the inlet tube is fixed to the vessel wall. The movable cleaning head is formed by a rotatable tube with blowing nozzles that direct the pressurized blowing medium towards the heat transfer structure. The rotatable tube is coupled to the fixed inlet tube within the vessel chamber, which provides a cleaning device without movable mechanical elements that traverse the pressure boundary. In a second embodiment, the rotatable blowing tube is supported between a rotary, coupled connection to the sootblower inlet tube at one end and a similar connection to a stub tube extending inwardly from the vessel wall at an opposite end. In a third embodiment, the cleaning device is of the rapper type, in which the movable cleaning head is a hammer on one end of a rod extending from an actuator piston. The invention also relates to a method, applicable to all three embodiments, in which the pneumatic actuator is used to seal an opening into the vessel chamber, thereby eliminating the penetration of the pressure boundary by rotatable tubes, slidable shafts and the like.

It is a primary object of the invention to eliminate the need for a ring-shaped flexible seal around a movable mechanical element that extends through the wall of a heat exchanger vessel. In a high-pressure heat exchanger, this eliminates these seals at the pressure boundary between the vessel chamber and the environment outside of the walls of the heat exchanger.

It is another object of the invention to provide an actuator in which the timing of the stroke of its piston can be varied to provide an actuator for either a rapper or a sootblower cleaning device.

It is another object of the invention to provide a sootblower and a tube rapper for heat exchangers containing hot gases at pressures of sixty pounds per square inch or greater.

It is another object of the invention to provide a sootblower and rapper for heat exchangers in which a noxious gas or a potentially combustible gas is circulated within its vessel chamber.

It is another object of the invention to provide a method and means for cooling the parts of the actuator and keeping them free of ash or dust build-up.

It is another object of the invention to operate a sootblower actuator from the same source of blowing medium that is discharged through the movable sootblower tube to clean the heat transfer structure.

The foregoing and other objects and advantages of the invention will appear from the following description. In the description reference is made to the accompanying drawings which form a part hereof, and in which there is shown by way of illustration the preferred embodiments of the invention. Such embodiments, however, do not necessarily represent the full scope of the invention, which has been expressed in the claims following the description.

BRIEF DESCRIPTION OF THE DRAWINGS

FIG. 2 is a sectional view taken in the plane indicated by line 2—2 in FIG. 1.

FIG. 3 is a sectional view taken in the plane indicated by line 3—3 in FIG. 1.

FIG. 4 is a sectional view of a first sootblower embodiment of the invention taken in the plane indicated by line 4—4 in FIG. 3.

FIG. 5 is a sectional view of the soot blower of FIG. 4 taken in the plane indicated by line 5—5 in FIG. 4 with a portion broken away.

FIG. 6 is a fragmentary sectional view of a second sootblower embodiment of the invention seen in FIG. 3.

DESCRIPTION OF THE PREFERRED EMBODIMENT

Figure 1:
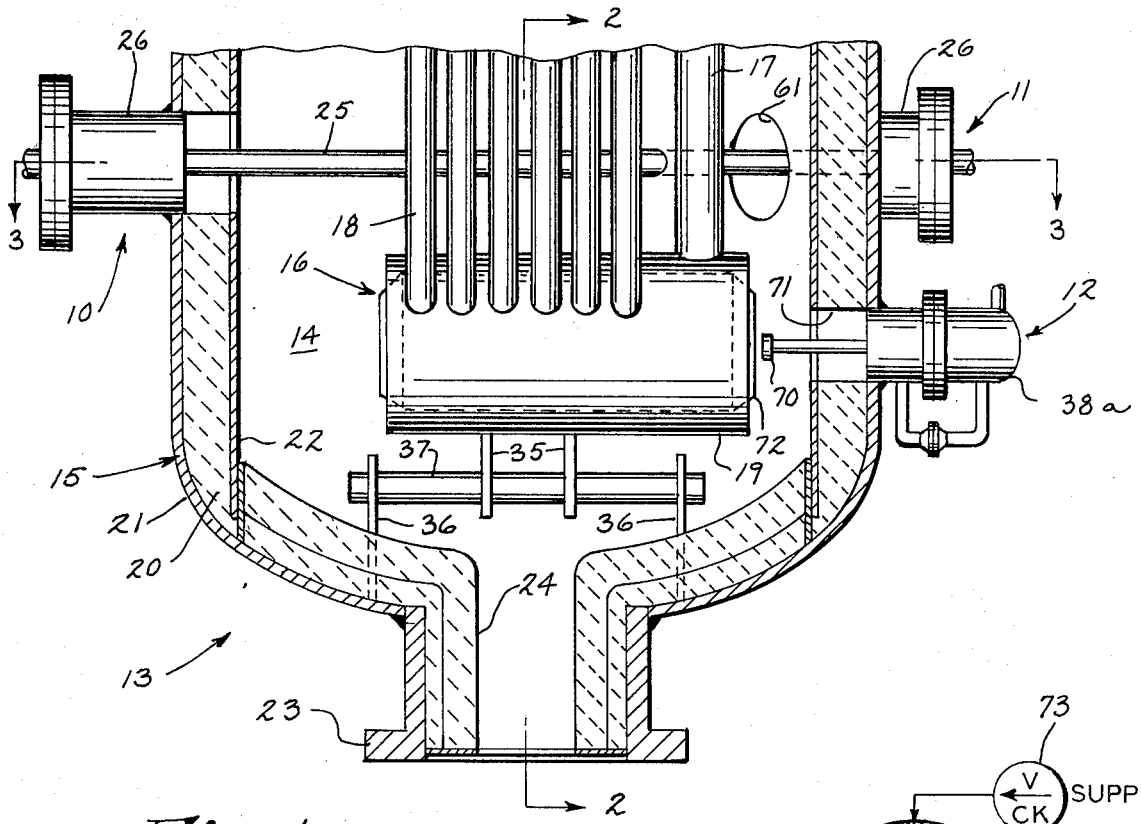
FIG. 1 is a fragmentary side view in elevation of a boiler in which the soot cleaning devices of the invention are installed.

Referring to FIG. 1, three soot cleaning devices 10–12 each embodying the present invention are mounted to a lower portion of a boiler 13. Boilers are used for the transfer and recovery of heat from hot gaseous products and by-products of industrial processes. In the industrial environment, these hot gaseous products or by-products are dirty gases which carry particles of soot, ash or other sediment. When such a gas is circulated in the chamber 14 of a boiler vessel 15 of the type seen in FIG. 1, the particles become caked on the outer surfaces of a heat transfer structure 16, which includes a downcomer pipe 17, vertical water tubes 18 and a drum-shaped lower header 19. Other parts of the heat transfer structure, which have not been shown in FIG. 1, but which are familiar to those skilled in the art are an upper header, and a riser pipe through which steam exits the boiler. It will also be understood by those skilled in the art that there is an inlet port into the vessel 15 through which the hot dirty gas enters the chamber 14 to circulate around the heat transfer structure 16, before exiting at a somewhat lower temperature through an outlet port formed in the vessel.

The boiler 13 in this example is a vertical water tube boiler which uses water and water vapor to absorb heat from the hot gas circulating in the vessel chamber 14. The water is under pressure and is forced downward through the downcomer pipe 17 into the lower header 19. From there it rises due to the water pressure and due to the heating and expansion of the water to produce steam, which rises through the water tubes 18 and is eventually exhausted from the boiler 13. This steam can be used to power a steam turbine or it can be other parts of the industrial process carried on in the plant.

The invention is applicable to a wide range of heat exchangers—wherever auxiliary cleaning devices must be attached without allowing pressurized dirty gas in the exchanger vessel to leak into the plant environment. The invention is particularly applicable to boilers used to recover heat from coal gasification processes, where the gas in the vessel chamber 14 is very hot, and is potentially combustible if released into the normal oxygen-containing atmosphere. The hot gas within a vessel of the type seen in FIG. 1 would typically be at a pressure around sixty pounds per square inch but could be as high as 600 psi for some processes. The annular pressure seals of the prior art are not suitable for sealing around the movable shafts and tubes of soot cleaning devices that would penetrate the cylindrical sidewall of such a vessel 15.

To be suitable for use in coal gasification plants, the heat transfer structure in FIG. 1 may be calorized to inhibit corrosion. The cylindrical sidewall of the vessel is formed by a blanket of compressed ceramic heat-insulating material 20 that is sandwiched between an outer pressure containing metal shell 21 and an inner stainless steel liner 22. The outer shell 21 curves around the bottom of the vessel to a flanged, cylindrical down spout 23. A hopper (not shown) can be attached to the flange on the down spout 23 to collect soot from the cleaning operations that will be described. The bottom of the vessel, including the interior of the spout 23, is lined with the refractory material 24 that deflects heat and keeps the vessel bottom from becoming too hot.

Referring to FIGS. 1–3, the first soot cleaning device 10 of the invention is a rotary sootblower. Its cleaning head is a rotary blowing tube 25 that extends horizontally between the third and fourth rows of an array of the vertical water tubes 18 as seen in FIG. 3. The blowing tube 25 is supported within a vessel nozzle 26 that extends radially outward from the vessel sidewall and is axially aligned with the blowing tube 25 along a diameter of the cylindrical vessel 15. The nozzle 26 is welded to the shell 21 around a cylindrical opening 27 that extends through the shell 21, the insulating blanket 20 and the liner 19 constituting the vessel sidewall. The vessel nozzle 26 effectively extends the sidewall and chamber 14 of the vessel 15.

FIG. 5 shows the details within the interior of the nozzle 26. There, the inlet end of the blowing tube 25 is received and rotatably mounted in one end of a bearing sleeve 28. The sleeve 28 is of larger diameter than the blowing tube 25 and also receives the discharge end of a stationary inlet tube 29, which is of the same diameter as the blowing tube 25 in this example. The bearing sleeve 28 is welded to the inlet tube 29, and the inlet tube 29 extends through and is welded to a flat, circular cover plate 30 for the nozzle 26. A relatively cool blowing medium flows into the inlet tube 29 and blowing tube 25 through valves 31–33. The blowing medium is discharged through one or more blowing tube nozzles 34 in a generally downward direction as seen in FIGS. 2 and 5.

It will be observed in FIG. 2 that the blowing tube 25 extends through a space between the crooked ends of the water tubes 18, which are curved to connect to the lower header 19 close to normal to its cylindrical wall at angularly spaced locations. The heat transfer structure 16 is suspended from the top of the boiler 13, and to protect against lateral movement that would disturb the blowing tube 25, the lower header 19 is anchored as seen in FIGS. 1 and 2. The lower header is attached to two downwardly extending, spaced apertured plates 35. These are aligned with two other spaced apertured plates 36 rising upwardly from the bottom of the vessel shell 21. A pipe 37 slides through one of the upwardly rising plates 36, through the two downwardly extending plates 35 and then through the other upwardly rising plate 36 to hold the lower header 19 in position but allowing for differential expansion in the vertical direction.

Referring to FIG. 3, an actuator 38 for the blowing tube 25 extends at a right angle relative to the longitudinal axis of the vessel nozzle 26. As seen somewhat better in FIG. 4, the actuator 38 has a flanged, tubular section 39 fixed around an opening into the nozzle 26. A cap section 40 is welded to a vertical flange 41 that abuts the flange of the tubular section 39 to form a housing for a horizontally extending pressure cylinder 42. Within this cylinder 42, a connecting rod 43 slides horizontally through an opening in the flange 41. The rod 43 extends from a piston 44 carried on its outer end to a connection at its inner end to the rotatable blowing tube 25. A pin 46 extends at a right angle to the axis of the connecting rod 43 and is received in a slot 45*a* along the axis of a crank arm 45 that extends radially from the blowing tube 25. The pin 46 is held in the slot by a retainer 47. The connecting rod 43 is also supported by an annular support member 48 between the flange 41 and the crank arm 45, the support 48 having a T-shaped cross section as seen in FIG. 4. The piston 44 is operated pneumatically and moves on a forward stroke corresponding to the length of the movement required for the connecting rod 43. When the connecting rod 43 advances, the crank arm 45 is pivoted to move the blowing tube 25 between first and second positions that are ninety degrees apart. The movement of the piston 44 is opposed by a return spring 49 which is coiled around the connecting rod 43 between the inner side of the piston 44 and the flange 41. The piston 44 is held against the return spring 49 by a frusto-conical stop 50 extending inwardly within the cap section 40 from the extreme outer end of the cylinder 42.

The hot gas within the vessel chamber 14 will circulate within the nozzle 26 seen in FIG.4, and then will become mixed with blowing medium to the extent it circulates upstream into the pressure cylinder 42. Ideally, the hot gas would be contained within the tubular section 39, and the portion of the cylinder therein, together with the interior of the vessel nozzle, shall be referred to as the containment region. The region in the cylinder 42 between the piston 44 and the flange 42 shall be referred to as the purge region, because a small flow of blowing medium is introduced there to cool and purge any of the hot gas, and to prevent ash from forming on the return spring 49 and the other internal parts of the actuator 38. The region of the cylinder 42 on the outer side of the piston 44 shall be referred to as the variable pressure region, because the pressure is increased in this region to overcome the force of the return spring 49 when the piston is moved on its forward stroke, and pressure is then decreased to allow the piston 44 to move on a return stroke. As the piston 44 moves on its forward stroke, the variable pressure region becomes larger while the purge region becomes smaller.

Still referring to FIG. 4, a purge inlet tube 51 is provided to communicate with an opening 52 into the purge region of the cylinder 42 so that a small volume of blowing medium can circulate in this region and out into the containment region to cool gas in the cylinder 42, and prevent ash build-up. A bypass conduit is formed above the cylinder housing in FIG. 4 by two flanged right angle conduit sections 53 and 54. The first section 53 is welded to the cap section 40 around an exhaust port 55 from the purge region and the second right angle section 54 is welded to the tubular section 39 to communicate with an inlet port 56 into the containment region. These sections 53 and 54 extend vertically upward and horizontally inward towards one another where their respective flanges are coupled together. Blowing medium is received into the variable pressure region through a supply port 57 formed in the cap section 40 of the actuator 38. On its forward stroke, the piston 42 will pass the exhaust port 55, so that some of the blowing medium in the variable pressure region will bypass the piston 42 through the conduit sections 53 and 54 and into the containment region, thereby lowering the pressure in the variable pressure region. This prevents overstroking of the piston 42. The force differential between the inner and outer sides of the piston 42 is moderate in this embodiment as the time interval for the stroke of the piston 42 is preferrably in the range of 10–15 seconds.

The admission of blowing medium into both the actuator 38 and the blowing tube 25 is controlled by a solenoid-actuated valve 33 (FIG. 5), which in turn is controlled by an electrical control circuit for the industrial process. The solenoid-actuated valve 33 is connected on one side to a source of blowing medium, and is connected on its other side to two parallel flow paths. The first flow path extends to the supply port 57 on the actuator 38, while the second flow path extends to the inlet tube 29. A metering valve 58 is connected in the first flow path to lower the pressure of the medium flowing to the actuator 38. It is not necessary or desirable to actuate the relatively gradual stroke of the actuator 38 with blowing medium at the same pressure that is used for the blowing medium exhausted through the blowing tube 25. An isolation valve 31 and a check valve 32 are connected in series in the second flow path to control the flow of blowing medium into the blowing tube 25. The check valve 32 performs in a conventional manner, allowing the blowing medium to flow in one direction only—into the inlet tube 29. Should pressure be lost in the sootblowing system the check valve will prevent flow of boiler gas beyond the check valve. The isolation valve 31 is simply a manually operated valve for sealing the inlet tube 29 when any external parts require maintenance. When the solenoid-actuated valve 33 is opened, and then closed at the end of the timed interval for stroking the piston, the metering valve 58 in the first flow path allows some of the blowing medium to flow backward into the second flow path and through these valves 31 and 32 to the inlet tube 29. From there, this portion of the blowing medium is exhausted through the blowing tube 25. An orifice device 59 is connected in a bleeder line between the source of blowing medium and the purge inlet tube 51 to provide a small volume of the medium for purging purposes.

Returning to FIGS. 2 and 3, a second sootblower 11 uses the same type of actuator 38 as the embodiment just described, but the blowing tube 61 and the nozzle 60 are located off center from the diameter of the vessel, along a chord of the circular cross section. In this example, the vessel nozzle 60 is located at the opposite end of the blowing tube from the first nozzle 26, however, it will be apparent that the devices 10–12 may be oriented in many ways relative to the height and circumference of the vessel 15 as well as relative to each other.

As shown in FIG. 6, the blowing tube 61 is made of stainless steel and has a plurality of downwardly aimed tube nozzles 62. The tube 61 is rotatably mounted between the inlet tube 63 and a stub tube 64 by bearing sleeves 65 and 66 at its opposite ends. The inlet tube 63 extends inwardly through a cover plate 67 of the nozzle 60 as in the first embodiment, while the stub tube 64 is welded to the liner 22 of the vessel wall. The blowing tube 61 is of the same diameter as the inlet tube 63 and the stub tube 64. The bearing sleeve 65 that mounts the blowing tube 61 to the inlet tube 63 has an inner diameter large enough to receive the respective ends of the tubes 61 and 63. This sleeve 65 is welded to the outside of the blowing tube 61 and extends for approximately half its own length over the end of the inlet tube 63. The bearing sleeve 66 at the other end is also welded to the rotatable blowing tube 61 and extends for approximately half its own length over the free end of the stub tube 64. At the end of this sleeve 66 there is an annular thrust bearing 68 which engages a corresponding bearing member 69 encircling and welded to the middle of the stub tube 64. The thrust bearing 68 allows the tube 61 to rotate while receiving the thrust that results from the force of the blowing medium flowing into the blowing tube 61 from the inlet tube 63.

Figure 7:
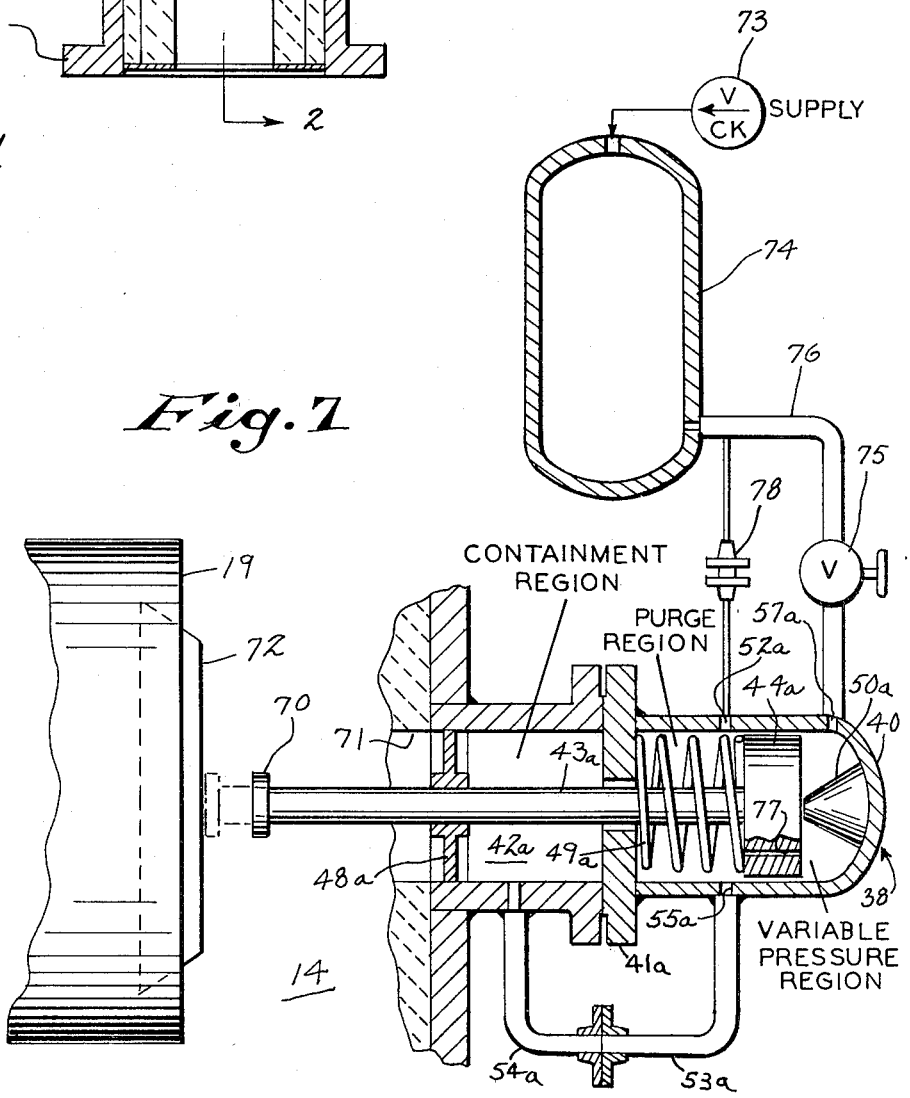
FIG. 7 is a sectional view of a third, tube wrapper embodiment of the invention taken in the plane indicated by line 7—7 in FIG. 3.

Referring to FIG. 7, there is shown a third soot cleaning device 12 which has a rapper head 70 carried on one end of a connecting rod 43*a* that carries a piston 44*a* on its other end. As seen in FIG. 3, the actuator 38*a* in this device 12 is not mounted to a vessel nozzle 26, but is mounted directly to the vessel shell 21 around an opening 71 into the vessel chamber 14. In this embodiment, the rapper head 70 moves rapidly and forcefully between first and second positions to strike a plug 72 at one end of the lower header 19 and shake the lower end of the heat transfer structure 16. As best illustrated in FIGS. 1 and 3 the header 19 is held against transverse movement by the apertured plates 35 and 36 and the pipe 37 extending longitudinally beneath the header 19 and through the plates 35 and 36, however, the header 19 can move a small amount longitudinally in reaction to the rap of the head 70.

Referring again to FIG. 7, the actuator 38*a* has a flanged, tubular section 39*a* fixed around the opening 71 into the vessel chamber 14, and a cap section 40*a* welded to a vertical flange 41*a* that abuts the flange of the tubular section 39*a* to form a housing for a pressure cylinder 42*a*. Within the horizontally disposed housing, the connecting rod 43*a* is horizontally disposed and slides through a central opening in the flange 41*a*. The connecting rod 43*a* is supported with an annular support member 48*a* with a T-shaped cross section. A return spring 49*a* is coiled around the connecting rod 43*a* between the inner side of the piston 44*a* and the flange 41*a*. The piston 44*a* is held against the return spring 49*a* by a frusto-conical stop 50*a* formed in the cap section 44*a* at the extreme end of the cylinder 42*a*.

For descriptive purposes, the cylinder 42*a* can be divided into three regions. The first is a containment region within the tubular section 39*a* where it is likely that some of the hot, pressurized gas from the vessel chamber will circulate after passing the support flange 43*a*. The middle region of the cylinder is the purge region, which is formed between the flange 41*a* and the inner side of the piston 44*a* where the return spring 49*a* is located. The region between the outer side of the piston head 42*a* and the extremity of the cylinder 42*a* shall be referred to as the variable pressure region, because the pressure in this region is increased by the admission of blowing medium to stroke the piston, and is later decreased to allow its return stroke. The blowing medium is admitted into the cylinder piston through a supply port 57*a* in the cap section 50*a*. In this embodiment the piston 44*a* executes a short rapid stroke in a fraction of a second. To accomplish this, the pressure of the blowing medium is stepped up and then quickly released into the variable pressure region of the cylinder 42*a*. The source of the blowing medium is connected through a check valve 73 to an accumulator 74 to increase the volume of the blowing medium. A remotely controlled, fast-acting ball valve 75 is connected in a flow path formed by a conduit 76 between the accumulator 74 and the supply port 57*a*. When this valve 74 is opened, a volume of the medium at sufficient pressure is introduced into the variable pressure region to force the piston through a rapid stroke.

A bypass conduit is formed below the cylinder housing by two flanged right angle conduit sections 53*a* and 54*a*. The first section 53*a* is welded to the cap section 40*a* and communicates with an exhaust port 55*a* therein and the second right angle section 54*a* is welded to the tubular section 39*a* to communicate with the inlet port 56*a* into the containment region. These conduit sections 53*a* and 54*a* extend vertically downward and then horizontally inward towards one another where their respective flanges are coupled together. On its forward stroke, the piston 44*a* will pass the exhaust port 55*a*, so that some of the blowing medium in the variable pressure region will bypass the piston 42*a* and enter the containment region, thereby lowering the pressure in the variable pressure region, to prevent overstroking of the piston 44*a*. In addition, a passageway 77 runs horizontally through the piston 44*a* from the variable pressure region to the purge region allowing some of the blowing medium to bleed through the piston 44*a*. This lowers the pressure in the variable pressure region and allows the piston 42*a* to move on its return stroke in response to the force of the return spring 49*a*. An orifice device 78 is connected in parallel to the conduit 76 and, more particularly, is connected in a bleeder line from the accumulator 74 to a purge inlet port 52*a* leading into the purge region of the cylinder 42*a*. This allows a small volume of blowing medium to bleed into the purge region, and from there into the containment region to cool the actuator parts and retard any ash build-up in the cylinder 42*a*.

It can be seen from the description of these three embodiments that the method of the invention involves positioning the movable cleaning head, whether it be a blowing tube or a rapper head, within the chamber and proximate to the heat transfer structure, where it will dislodge soot as it is moved between a first position and a second position. The opening into the vessel chamber, whether through a nozzle or otherwise, is sealed by mounting a valve-controlled pneumatic actuator to the vessel around the opening, the actuator having a pressure cylinder to communicate with the vessel chamber and the actuator having a piston mounted within the pressure cylinder and coupled to the cleaning head through the opening. The valve is kept closed to contain the pressurized gas from the vessel chamber in the actuator pressure cylinder and is then opened for a timed interval. While the gas in the vessel chamber is given as typically sixty pounds per square inch, the term "pressurized" as applied to this gas should be considered to mean greater than atmospheric pressure unless modified to be more specific. The blowing medium, which is at greater pressure than the gas in the vessel chamber, is introduced into the actuator cylinder to generate a force that moves the piston through a forward stroke. As the piston moves it will move the movable cleaning head from its first position to its second position.

The above description has provided several devices and a generally applicable method for carrying out the invention. The devices may be sold as items installed in heat exchangers or as kits for retrofitting existing heat exchangers. It will be apparent to those skilled in the art that other embodiments might be used as well. The above description has not therefore been intended as exhaustive of these embodiments, but instead, the scope of the invention has been defined by the following claims.

I claim:

1. Soot cleaning apparatus, which is operable with a source of a pressurized blowing medium, and which is adapted to seal an opening into a heat exchanger vessel, the opening leading into a chamber in which a heat transfer structure is positioned in a volume of a pressurized gas, the apparatus comprising:

a movable cleaning head adapted to be positioned in the chamber proximate the heat transfer structure for dislodging soot therefrom during a cleaning operation in which the cleaning head is moved between a first position and a second position; and a pneumatic actuator adapted to be fixed to the vessel around the opening, the actuator having a pressure cylinder that communicates at one end with the vessel chamber, a piston disposed in the cylinder between a containment region that communicates with the vessel chamber, and a variable pressure region that is on an opposite side of the piston from the containment region, a connecting rod that couples the piston to the movable cleaning head, and means for admitting into the variable pressure region of the cylinder, for a timed interval, a blowing medium at greater pressure than the gas in the vessel chamber to generate a force that moves the piston through a forward stroke to move the cleaning head from its first position to its second position.

2. The soot cleaning apparatus of claim 1, wherein:

the actuator forms a purge inlet port that communicates with a purge region in the cylinder through which the piston travels during its forward stroke; and further comprising orifice means coupled between the source of pressurized blowing medium and the purge inlet port to introduce a purging flow of the blowing medium at a lower pressure than is used to move the piston but at a higher pressure than the gas in the containment region, whereby a relatively cooler blowing medium will mix with and displace a relatively hotter gas from the vessel chamber to cool the actuator and retard ash build-up therein.

3. The soot cleaning apparatus of claim 1, wherein the actuator also includes a conduit with one end communicating with the cylinder in a region through which the piston passes on its forward stroke, and with an opposite end communicating with the containment region, so that as the piston passes the one end of the conduit of its forward stroke, some of the blowing medium will bleed through the conduit, bypassing the piston and lowering the pressure in the variable pressure region to limit the stroke of the piston.

4. The soot cleaning apparatus of claim 1, wherein the piston has a passageway through it from the variable pressure region to a region communicating with the containment region, to allow the blowing medium to bleed through the piston after its forward stroke to lower the force opposing the return stroke of the piston.

5. The soot cleaning apparatus of claim 1, wherein the means for admitting the blowing medium includes first valve means in a flow path into the variable pressure region of the cylinder for lowering the pressure of the blowing medium as it flows from the source to the actuator cylinder to extend the time interval for the forward stroke of the piston.

6. The soot cleaning apparatus of claim 5, wherein:

the first valve means allows some flow of the blowing medium in a reverse direction through the flow path from the variable pressure region as the piston moves on a return stroke;

wherein the means for admitting the blowing medium includes second valve means coupled between the source of blowing medium and the first valve means, for opening to admit blowing medium into the first flow path for a preselected time interval and then closing just as the piston completes its forward stroke; and further comprising check valve means coupled to the first valve means to receive any reverse flow of blowing medium therethrough and coupled to the second valve means to receive blowing medium from the source, the check valve means allowing the blowing medium to flow in the inlet direction only into the cleaning head where the blowing medium is exhausted into the vessel chamber.

7. The soot cleaning apparatus of claim 1, further comprising:

an inlet tube to receive the blowing medium for cleaning purposes, the inlet tube being adapted to be fixed to the heat exchanger and extend into the heat exchanger chamber; and wherein the cleaning head is a blowing tube with at least one nozzle for directing the blowing medium towards the heat transfer structure, the blowing tube being rotatably coupled at one end to the portion of the inlet tube adapted to extend into the heat exchanger chamber and being adapted to be coupled to the connecting rod for rotary actuation in response to the movement of the connecting rod with the piston.

8. The soot cleaning apparatus of claim 7, wherein:

the blowing tube is rotatably coupled at an opposite end to a stub tube extending inwardly from the vessel wall, so that the blowing tube is rotatably supported between the inlet tube and the stub tube.

9. The soot cleaning apparatus of claims 7 or 8, wherein:

the blowing tube is coupled by a pin on the connecting rod and the pin is retained in a slotted crank arm extending radially from the blowing tube, the crank arm being pivoted in response to linear movement of the connecting rod to rotate the blowing tube.

10. The soot cleaning apparatus of claim 1, wherein the cleaning head raps the heat transfer structure when the piston moves through its forward stroke.

11. Sootblowing apparatus, which is operable with a source of blowing medium, and which is adapted to be installed and operated on a pressurized heat exchanger vessel without moving mechanical parts penetrating into the vessel chamber from an outside environment at lower pressure, the apparatus comprising:

an inlet tube adapted to be fixed to the heat exchanger vessel with a portion adapted to extend into the vessel chamber, the inlet tube being connectable to the source of blowing medium to convey blowing medium into the vessel chamber;

a blowing tube rotatably coupled to the portion of the inlet tube which is adapted to extend into the vessel chamber, the blowing tube having at least one nozzle for discharging the blowing medium towards a heat transfer structure within the vessel chamber; and a pressurized pneumatic actuator adapted to be fixed to the heat exchanger vessel and adapted to close around an opening into the vessel chamber, the actuator being pressurized to the pressure within the heat exchanger chamber, and the actuator having a pneumatically-responsive movable member that is adapted to be coupled to the blowing tube to move the blowing tube between a first position and a second position.

12. A method of actuating and sealing a device that removes soot, ash or other sediment from a heat transfer structure that is disposed within a chamber of a heat exchanger vessel that contains a pressurized gas, the method comprising:

positioning a movable cleaning head within the chamber and proximate to the heat transfer structure to dislodge soot therefrom as the cleaning head is moved between a first position and a second position;

sealing an opening into the vessel by mounting a valve-controlled pneumatic actuator around the opening, the actuator having a pressure cylinder that is positioned to communicate with the vessel chamber through the opening and the actuator having a piston that is mounted within the pressure cylinder and coupled to the cleaning head through the opening;

keeping the valve closed to contain the pressurized gas from the vessel chamber in the actuator pressure cylinder; and operating the movable cleaning head by opening the valve for a timed interval to introduce a blowing medium, at greater pressure than the gas in the vessel chamber, into the actuator cylinder to generate a force that moves the piston through a forward stroke, to move the cleaning head between its first and second positions.

13. The method of claim 12, further comprising the step of:

introducing the blowing medium into the movable cleaning head; and wherein the cleaning head is moved between its first and second positions as the blowing medium is discharged therefrom onto the outer surface of the heat transfer structure.

14. The method of claim 13, wherein:

the movable cleaning head is rotatably operated between its first and second positions.

15. The method of claim 13, further comprising the step of recirculating some of the blowing medium from the pressure cylinder to the movable cleaning head as the piston moves from its second position to its first position on a return stroke.

16. The method of claim 12, further comprising the step of lowering the pressure of the blowing medium after the valve is opened and before the blowing medium is introduced into the actuator cylinder to extend the time of the forward stroke of the piston.

17. The method of claim 12, further comprising the step of continuously purging the cylinder with a flow of blowing medium that is cooler than the gas in the vessel chamber to retard ash build-up near the piston.

18. The method of claim 12, further comprising the step of conducting some of the blowing medium so that it bypasses the piston during its forward stroke.

19. The method of claim 12, further comprising the step of bleeding some of the blowing medium through the piston to control its return stroke.

20. The method of claim 12, further comprising the step of accumulating the blowing medium received from an external source to increase the available volume of blowing medium prior to its introduction into the actuator cylinder.

* * * * *

UNITED STATES PATENT AND TRADEMARK OFFICE

CERTIFICATE OF CORRECTION

PATENT NO. : 4,421,067

DATED : December 20, 1983

INVENTOR(S) : Robert J. Krowech

It is certified that error appears in the above—identified patent and that said Letters Patent is hereby corrected as shown below:

Column 9, line 53 - "of" second occurrence should be --on--.

Signed and Sealed this

*Twenty-first* Day of *February 1984*

[SEAL]

*Attest:*

GERALD J. MOSSINGHOFF

*Attesting Officer*

*Commissioner of Patents and Trademarks*